US007876270B2

(12) United States Patent
Fabrega-Sanchez et al.

(10) Patent No.: US 7,876,270 B2
(45) Date of Patent: Jan. 25, 2011

(54) MODEM CARD WITH BALANCED ANTENNA

(75) Inventors: Jorge Fabrega-Sanchez, San Diego, CA (US); Gregory Poilasne, San Diego, CA (US); Mete Ozkar, Raleigh, NC (US); Vaneet Pathak, San Diego, CA (US)

(73) Assignee: Kyocera Corporation, Kyoto (JP)

( * ) Notice: Subject to any disclaimer, the term of this patent is extended or adjusted under 35 U.S.C. 154(b) by 956 days.

(21) Appl. No.: 11/686,720

(22) Filed: Mar. 15, 2007

(65) Prior Publication Data

US 2007/0152891 A1 Jul. 5, 2007

Related U.S. Application Data

(63) Continuation-in-part of application No. 10/940,935, filed on Sep. 14, 2004, now Pat. No. 7,239,290, and a continuation-in-part of application No. 11/339,926, filed on Jan. 25, 2006, now Pat. No. 7,408,517, which is a continuation-in-part of application No. 10/940, 935, filed on Sep. 14, 2004, now Pat. No. 7,239,290.

(51) Int. Cl.
*H01Q 1/24* (2006.01)

(52) U.S. Cl. ..... 343/702; 343/742; 343/867

(58) Field of Classification Search ..... 343/702, 343/726, 741, 742, 866, 867, 793
See application file for complete search history.

(56) References Cited

U.S. PATENT DOCUMENTS

| | | | | |
|---|---|---|---|---|
| 3,882,506 A | | 5/1975 | Mori et al. | |
| H1571 H | | 8/1996 | Hansen et al. | |
| 5,563,772 A | * | 10/1996 | Nichols | 361/752 |
| 5,945,958 A | | 8/1999 | Staufer et al. | |
| 6,020,857 A | | 2/2000 | Podger | |
| 6,104,354 A | | 8/2000 | Hill et al. | |
| 6,144,346 A | | 11/2000 | Boy | |
| 6,204,817 B1 | | 3/2001 | Edvardsson | |
| 6,239,755 B1 | | 5/2001 | Klemens et al. | |
| 6,456,243 B1 | | 9/2002 | Poilasne et al. | |
| 6,486,848 B1 | | 11/2002 | Poilasne et al. | |
| 6,573,867 B1 | | 6/2003 | Desclos et al. | |
| 6,593,886 B2 | * | 7/2003 | Schantz | 343/700 MS |
| 6,600,450 B1 | | 7/2003 | Efanov et al. | |
| 6,624,795 B2 | | 9/2003 | Boyle | |
| 6,675,461 B1 | | 1/2004 | Rowson et al. | |

(Continued)

FOREIGN PATENT DOCUMENTS

DE 8814993 3/1989

(Continued)

OTHER PUBLICATIONS

Japanese Patent Office Action issued Mar. 4, 2008 in corresponding Japanese Patent Application No. 2002-302420.

(Continued)

*Primary Examiner*—Tan Ho

(57) ABSTRACT

A cellular modem card that conforms to a PCMCIA standard includes a balanced antenna. The balanced antenna minimizes susceptibility to limited available ground plane and limited ground connections between the modem card and a host device, such as laptop computer. The balanced antenna may be a dipole antenna, loop antenna, capacitively loaded antenna, or any other suitable balanced antenna.

20 Claims, 11 Drawing Sheets

U.S. PATENT DOCUMENTS

| | | | | |
|---|---|---|---|---|
| 6,693,599 | B1 | 2/2004 | Chia et al. | |
| 6,697,025 | B2 | 2/2004 | Koyanagi et al. | |
| 6,765,846 | B2 | 7/2004 | Saitou et al. | |
| 6,924,768 | B2 * | 8/2005 | Wu et al. | 343/702 |
| 6,958,735 | B2 | 10/2005 | Handelsman | |
| 7,155,258 | B1 * | 12/2006 | Cisar | 455/562.1 |
| 7,187,332 | B2 | 3/2007 | Kezys et al. | |
| 7,239,290 | B2 * | 7/2007 | Poilasne et al. | 343/866 |
| 7,408,517 | B1 * | 8/2008 | Poilasne et al. | 343/742 |
| 7,486,241 | B2 * | 2/2009 | Qi et al. | 343/702 |
| 2006/0038730 | A1 | 2/2006 | Parsche | |
| 2006/0079177 | A1 | 4/2006 | Okubora | |

FOREIGN PATENT DOCUMENTS

| | | |
|---|---|---|
| EP | 1134840 | 9/2001 |
| EP | 1217685 | 6/2002 |
| GB | 2308745 | 7/1997 |
| WO | WO01/33664 | 5/2001 |
| WO | WO 02/071536 | 9/2002 |

OTHER PUBLICATIONS

Patent Abstracts of Japan Pub. No. 2004-104704 published Apr. 2, 2004.

Masateru Chijiya, "MobileMotion™ MPEG-4 Video Streaming Software", Toshiba Review, Japan, Kabushiki Kaisha Toshiba, Jun. 1, 2002, vol. 57, No. 6, pp. 38-41.

Internet Document: Computer Translation of document DE-8814993-U 'Description' (at http://www.freetranslation.com/view.asp (Feb. 6, 2006).

* cited by examiner

MODEM CARD WITH BALANCED ANTENNA

RELATED APPLICATIONS

This is a continuation-in-part application of and claims the benefit of priority of U.S. patent application Ser. No. 10/940,935, filed on Sep. 14, 2004, now U.S. Pat. No. 7,239,290 and of U.S. patent application Ser. No. 11/339,926, filed on Jan. 25, 2006, now U.S. Pat. No. 7,408,517 which is a continuation-in-part application of and claims the benefit of priority of U.S. patent application Ser. No. 10/940,935, filed on Sep. 14, 2004, now U.S. Pat. No. 7,239,290 the disclosures of which are incorporated by reference in its entirety, herein.

TECHNICAL FIELD

This invention generally relates to wireless communication and, more particularly, to modem card antennas.

BACKGROUND

The Personal Computer Memory Card International Association (PCMCIA) has defined standards for computer cards which are often referred to as PCMCIA cards and PC cards. PCMCIA cards may provide any of several functions or resources to host devices such as a desktop computer or laptop computer. For example, memory PC cards provide additional memory storage that may be used by a host device. Some PC cards are adapters to one or more defined connector interfaces such as USB, Ethernet, and other IEEE standards. Wireless modem cards facilitate communications between the host device to a wireless network. Wireless signals are transmitted and received through one or more antennas connected to electronics within the modem card. The performance of wireless modem cards conforming to PCMCIA standards is limited, however, due to restrictions on ground connections. PCMCIA standards were originally intended for PC cards that performed functions other than wireless communication. Accordingly, the grounding connection between the host and the modem card through a PCMCIA connector is not intended to provide grounding for radio frequency (RF) circuitry in the modem card. As a result, the ground connection is limited in that it includes relatively thin conductors that introduce inductance and resistance from the host to the ground plane of the modem card. Conventional wireless modem cards utilize unbalanced antennas that require a counterpoise. Since the counterpoise in a conventional PCMCIA wireless modem typically relies on the ground of the device, the PCMCIA connector limits the adequacy of the ground at the wireless modem and, therefore, limits antenna performance. Further, currents on the ground plane caused by radiating energy from the conventional PCMCIA modem card antennas reduce receiver sensitivity.

Therefore, there is a need for a wireless modem card with an antenna having a minimum reliance on the ground provided through the wireless modem connector.

SUMMARY

A cellular modem card that conforms to a PCMCIA standard includes a balanced antenna. The balanced antenna minimizes susceptibility to limited available ground plane and limited ground connections between the modem card and a host device, such as laptop computer. The balanced antenna may be a dipole antenna, loop antenna, capacitively loaded antenna, or any other suitable balanced antenna.

DETAILED DESCRIPTION

Figure 1A:
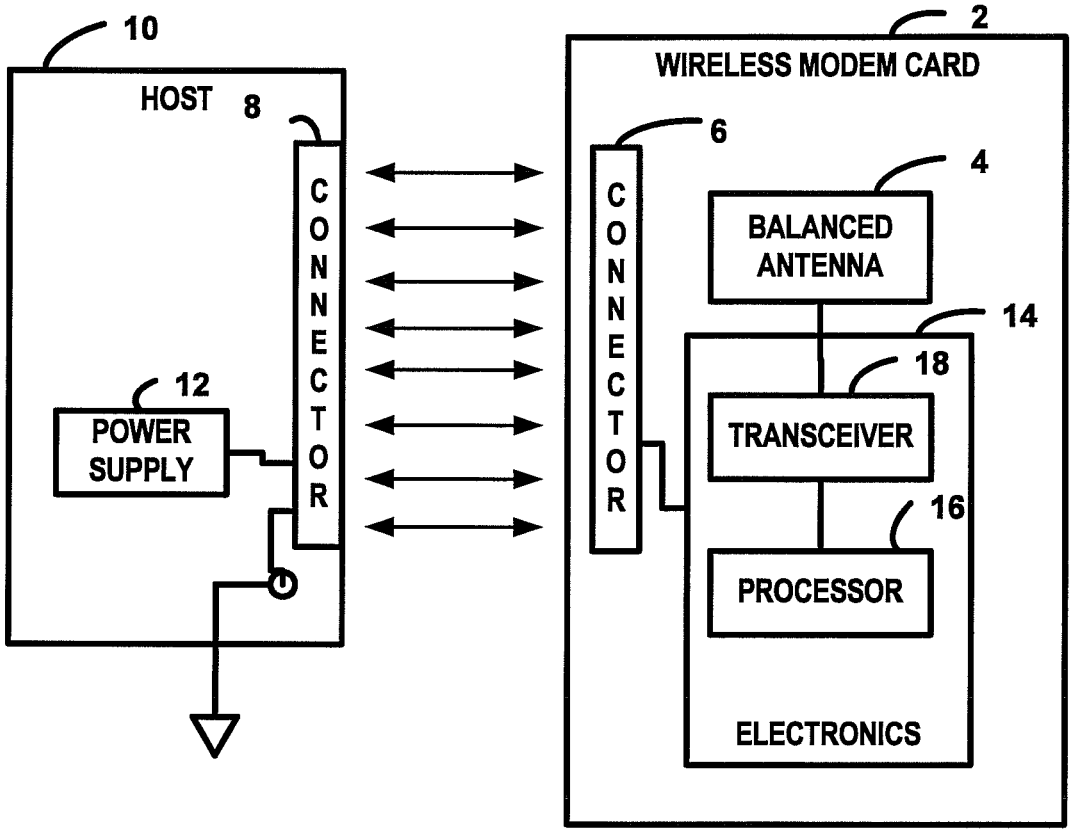
FIG. 1A is a block diagram of a cellular modem card with a balanced antenna in accordance with the exemplary embodiment of the invention.

FIG. 1A is a block diagram of a wireless modem card 2 with a balanced antenna 4. In the exemplary embodiment, the wireless modem card 2 is a cellular modem card that communicates with one or more base stations using a cellular communication standard such as CDMA or GSM. In addition to the balanced antenna 4, the cellular modem card 2 includes a connector 6 that permits the modem card 2 to be detachably connected to a connector 8 in a host 10 such as computer. The modem card 2 conforms to a Personal Computer Memory Card International Association (PCMCIA) standard. Accordingly, the dimensions and pin configuration of the connector 6 meet the requirements of one of the PCMCIA standards. In other embodiments, modem card 2 may conform to different standardized interface configuration. For instance, PC cards typically employ a 68-contact, dual row pin and socket connector while an Express Card typically employs a 26-contact beam on blade connector. The host 10 can include a port or a slot configured to receive or a portion of the modem card 2. In general, the host 10 includes a port or a slot configured to receive a portion of the modem card 2 such that another portion of the modem card 2 extends outside of the host 10. The connector 6 can be positioned in the port or slot such that the connector 6 on the modem card 2 is connected with the connector 8 on the host 10.

The host 10 includes a power supply 12 that provides power to electronics 14 in the modem card 2 through the connectors 6, 8. For instance, modem cards 2 typically operate at about 5 V or 3.3 V. In some instances, the power supply 12 provides power to the modem card 2 at about 5 V or at about 3.3 V.

The electronics 14 include a processor 16 for controlling and otherwise facilitating operations of the modem card. A suitable processor 16 includes, but is not limited to, a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions attributed to the electronics 14 and/or the processor 16. A general purpose processor may be a microprocessor. In the alternative, the processor 16 may be any conventional processor, controller, microcontroller, or state machine. A processor 16 may also be implemented as a combination of computing devices, e.g., a combination of a DSP and a microprocessor, a plurality of microprocessors, one or more microprocessors in conjunction with a DSP core, or any other such configuration.

The electronics 14 are in communication with the balanced antenna 4. For instance, the electronics 14 include a transceiver 18 in communication with the balanced antenna. The processor 16 is in communication with the transceiver 18. In some circumstances, the processor 16 may form at least part of the transceiver 18. The processor 16 can employ the transceiver 18 to wirelessly transmit signals to the base station and to wirelessly receive signals from the base station. In some cases, the transceiver 18 may be implemented as a separate transmitter and receiver. The balanced antenna 4 can be configured to resonate at radiofrequencies (RF) and can accordingly be an RF antenna for transmitting and/or receiving RF signals. Suitable balanced antennas 4 include, but are not limited to, dipole, loop, and capacitively loaded loop antennas.

As discussed above, design constrains due to PCMCIA standards limit performance of the conventional PCMCIA wireless modem cards. The grounding connection from the host 10 to the modem card 2 is limited in that it includes relatively thin conductors that introduce inductance and resistance from the host 10 to the ground plane of the modem card 2. Although laptop computers have slots for grounding connections to the PC cards, the grounds are typically insufficient to provide an adequate RF ground especially at higher frequencies. Currents on the ground plane caused by radiating energy from the conventional PCMCIA antennas reduce receiver sensitivity. In the exemplary embodiment, however, the balanced antenna 4 is not as susceptible poor ground conditions. The balanced antenna also acts to reduce the amount of radiation-associated current in the ground plane, thus improving receiver sensitivity.

In the exemplary embodiment, the balanced antenna 4 is a capacitively-loaded loop radiator antenna. Also, the balanced antenna 4 minimizes the susceptibility of the counterpoise to detuning effects that degrade the far-field electro-magnetic patterns. The antenna loop is capacitively-loaded and confines the electric field to reduce the overall size (length) of the radiating elements.

The exemplary balanced antenna 4 comprises a transformer loop having a balanced feed interface and a capacitively-loaded loop radiator. In one aspect, the capacitively-loaded loop radiator is a balanced radiator. Alternately, the capacitively-loaded loop radiator can be considered to be a quasi-balanced radiator, as explained below, including a quasi loop and a bridge section. In one aspect, the transformed loop and quasi loop are physically connected. That is, the transformer loop has a perimeter and the quasi loop has a perimeter with at least a portion shared by the transformer loop perimeter. Alternately, the loops are physically independent of each other.

In another aspect, the perimeters have a rectangular shape. Other shapes such as round or oval are also possible. In another aspect, the planes formed by the transformer and quasi loop are coplanar. Alternately, the planes are non-planar, while both being orthogonal to a common magnetic near-field generated by the transformer loop. Thus, whether connected or not, the loops are coupled.

Typically, the quasi loop has a capacitively-loaded side, or capacitively-loaded perimeter section. The capacitively-loaded side includes the bridge section interposed between quasi loop end sections. The bridge section can be a dielectric gap or lumped element capacitor.

Figure 1B:
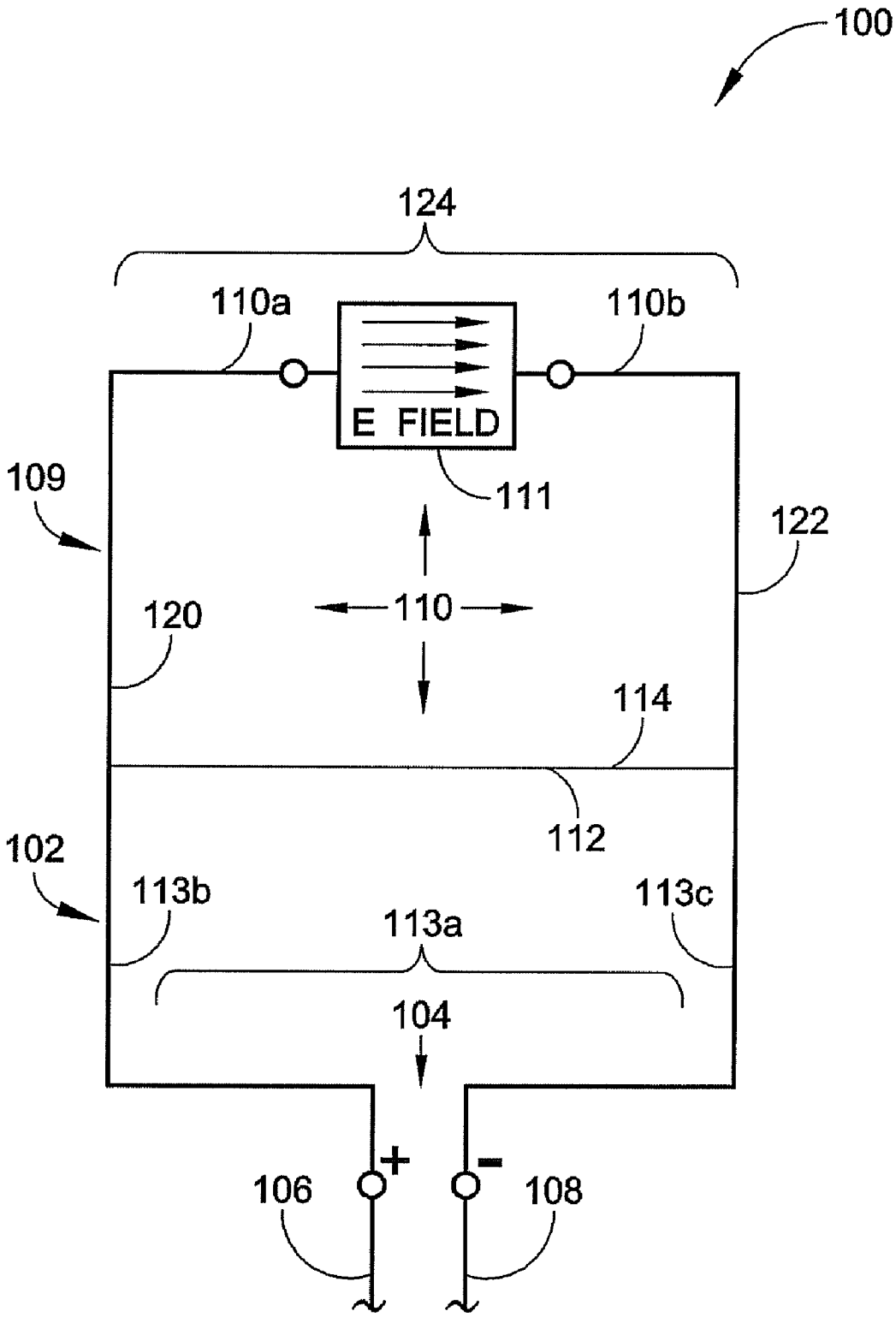
FIG. 1B is a plan view of the exemplary capacitively-loaded loop antenna.

FIG. 1B is a plan view of the an example of a capacitively-loaded loop antenna 100 suitable for use as the balanced antenna 4. The antenna 100 comprises a transformer loop 102 having a balanced feed interface 104. The balanced feed interface 104 accepts a positive signal on line 106 and a negative signal (considered with respect to the positive signal) on line 108. In some aspects, the signal on line 108 is 180 degrees out of phase of the signal on line 106. The antenna 100 also comprises a capacitively-loaded loop radiator (CLLR) 109.

Typically, the capacitively-loaded loop radiator 109 is a balanced radiator. A dipole antenna is one conventional example of a balanced radiator. The capacitive loading that advantageously affects to overall size of the CLLR 109, however, makes the antenna more susceptible to influences that unbalance the radiator. That is, the antenna is not always a perfectly balanced radiator, or is only perfectly balanced in a limited range of frequencies. For this reason, the CLLR 109 is sometimes described as a quasi-balanced radiator. The CLLR 109 includes a quasi loop 110 and a bridge section 111. As defined herein, a quasi loop 110 has loop end sections that are substantially, but not completely closed (in contact). The quasi loop 110 has a first end section 110*a* and second end section 110*b*. The bridge section 111 is interposed between the first end section 110*a* and the second end section 110*b*. The bridge section can be a dielectric gap capacitor (see FIG. 1C) or a lumped element capacitor (see FIG. 10). However, as explained below, the bridge section can be other elements that act to confine an electric field.

That is, the antenna 100 of FIG. 1B can be understood as a confined electric field magnetic dipole antenna. As above, the antenna comprises a transformer loop 102 having a balanced feed interface 104. In this aspect, however, the antenna further comprises a magnetic dipole 109 with an electric field confining section 111. That is, the antenna can be considered as comprising a quasi loop 110 acting as an inductive element, and a section 111 that confines an electric field between the quasi loop first and second end sections 110*a* and 110*b*. The magnetic dipole 109 can be a balanced radiator, or quasi-balanced. As above, the electric field confining section 111 can be a dielectric gap capacitor or a lumped element capacitor. The confined electric field section couples or conducts substantially all the electric field between first and second end sections 110*a*/110*b*. As used herein, "confining the electric field" means that the near-field radiated by the antenna is mostly magnetic. Thus, the magnetic field that is generated has less of an interaction with the surroundings or proximate objects. The reduced interaction can positively impact the overall antenna efficiency.

The transformer loop 102 has a radiator interface 112 and the quasi loop 110 has a transformer interface 114 coupled to the transformer loop radiator interface 112. As shown in FIG. 1B, the transformer loop 102 and quasi loop 110 are physically connected. That is, the transformer loop 102 has a first perimeter and the quasi loop 110 has a second perimeter with at least a portion of the second perimeter in common with the first perimeter. As shown, the loops 102 and 110 are approximately rectangular shaped. As such, the transformer loop 102 has a first side, which is the radiator interface 112. Likewise, the quasi loop 110 has a first side that is the transformer interface 114. Note that sides 112 and 114 are the same. The transformer loop 102 performs an impedance transformation function. That is, the transformer loop balanced feed interface 104 has a first impedance (conjugately matched to the balanced feed 106/108), and wherein the radiator interface 112 has a second impedance, different than the first impedance. Thus, the quasi loop transformer interface 114 has an impedance that conjugately matches the radiator interface second impedance. The perimeter of transformer loop is the sum of sides 112, 113*a*, 113*b*, and 113*c*. The perimeter of quasi loop 110 is the sum of sides 114, 120, 122, and 124.

For simplicity, the exemplary embodiment will be described in the context of rectangular-shaped loops. However, the transformer loop 102 and quasi loop 110 are not limited to any particular shape. For example, in other variations not shown, the transformer loop and quasi loop 110 may be substantially circular, oval, shaped with multiple straight sections (i.e., a pentagon shape). Depending of the specific shape, it is not always accurate to refer to the radiator interface 112 and transformer interface 114 as "sides". Further, the transformer loop 102 and quasi loop 110 need not necessary be formed in the same shape. Even if the transformer loop 102 and the quasi loop 110 are formed in substantially the same shape, the perimeters or areas surrounded by the perimeters need not necessarily be the same. The word "substantially" is used above because the capacitively-loaded fourth side 124 (the first and second end sections 110*a*/110*b*) of the quasi loop 110 typically prevent the quasi loop from being formed in a geometrically perfect shape. For example, the quasi loop 110 of FIG. 1B is rectangular, but not a perfect rectangle.

Figure 2:
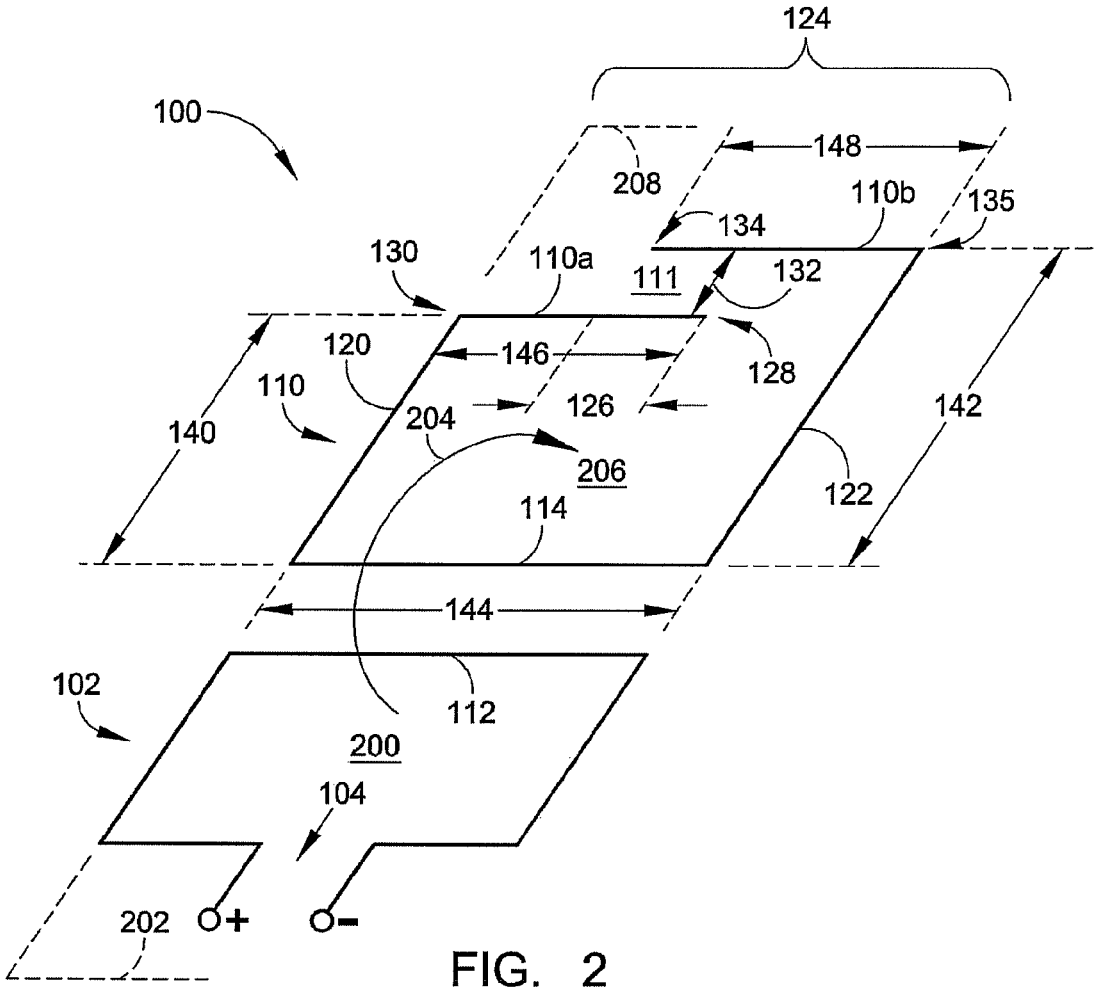
FIG. 2 is perspective view of a physically independent loop variation of the antenna of FIG. 1B.

FIG. 2 is perspective view of a physically independent loop variation of the antenna of FIG. 1B. In this variation, the transformer loop 102 and quasi loop 110 are not physically connected. Alternately stated, the transformer loop 102 and quasi loop 110 do not share any electrical current. Thus, the transformer loop 102 has a loop area 200 in a first plane 202 (shown in phantom) defined by a first perimeter, orthogonal to a first magnetic field (near-field) 204. The quasi loop 110 has a loop area 206 in a second plane 208 (in phantom), defined by a second perimeter, orthogonal to the first magnetic field 204. As shown, the transformer loop 102 first perimeter is physically independent of the quasi loop 110 second perimeter. Referring to either FIG. 1B or to FIG. 2, in one aspect of the antenna 100, the first plane 202 and the second plane 208 are coplanar (as shown).

Figure 3:
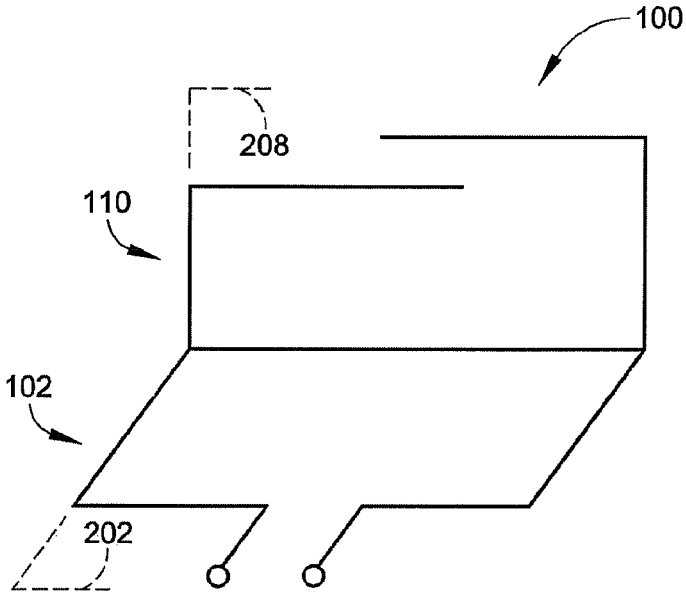
FIG. 3 is a perspective view showing a second variation of the antenna of FIG. 1B.

FIG. 3 is a perspective view showing a second variation of the antenna of FIG. 1B. In this variation, the transformer loop first plane 202 is non-coplanar with the second plane 208. Although the transformer loop 102 and quasi loop 110 are shown as physically connected, similar to the antenna in FIG. 1C, the first plane 202 and second plane 208 can also be non-coplanar in the physically independent loop version of the exemplary embodiment, similar to the antenna of FIG. 2.

Figure 1C:
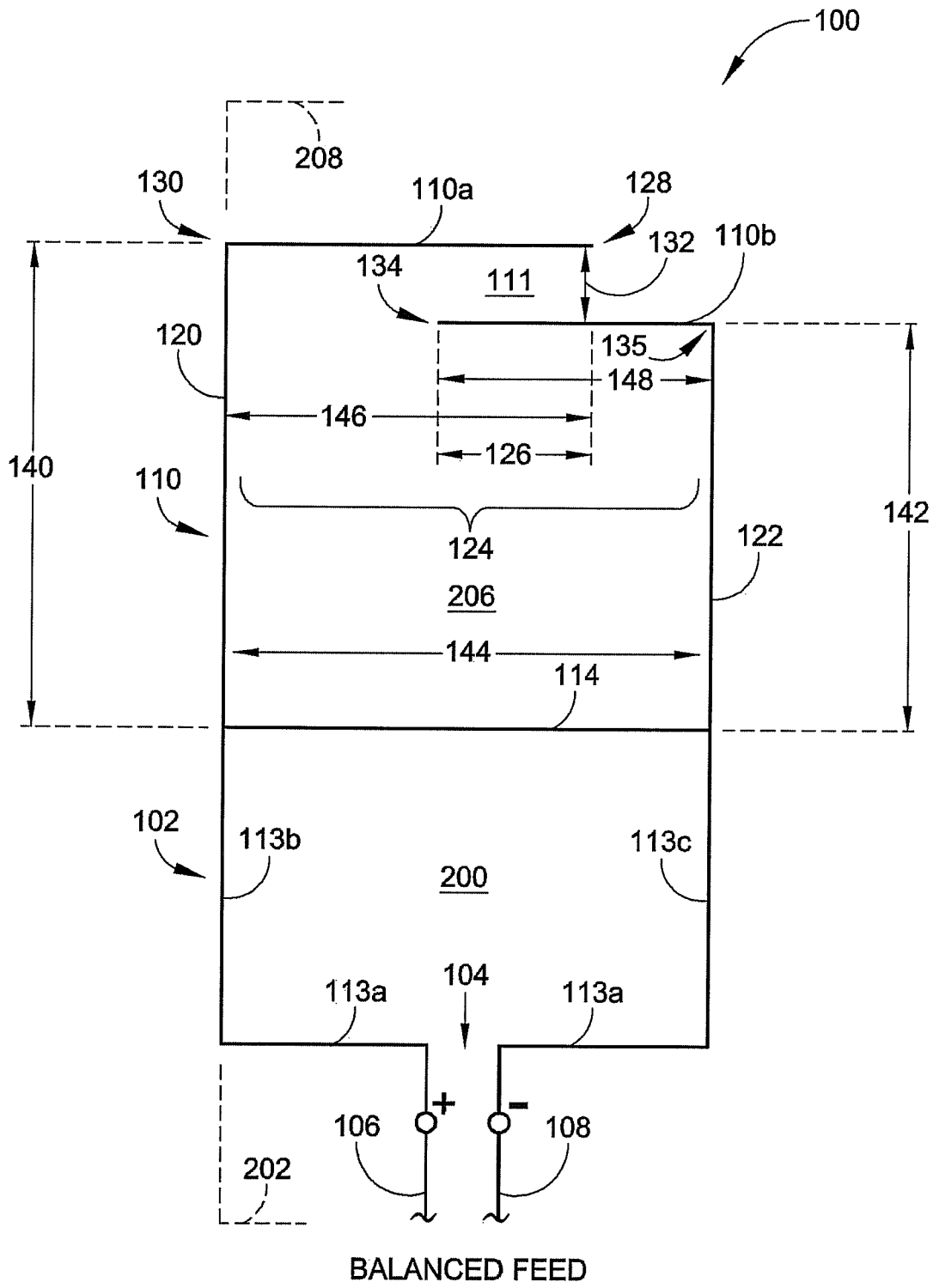
FIG. 1C is a plan view of a physically dependent loop variation of the antenna of FIG. 1B.

As shown, the first plane 202 and second plane 208 are non-coplanar (or coplanar, as in FIGS. 1C and 2), while being orthogonal to the near-field generated by the transformer loop 102. In FIGS. 1C, 2, and 3, the first and second planes 202/208 are shown as flat. In other aspects not shown, the planes may have surfaces that are curved or folded.

FIG. 1C is a plan view of a physically dependent loop variation of the antenna of FIG. 1B. The quasi loop first end section 110*a* includes a portion formed in parallel to a portion of the second end section 110*b*. Alternately stated, the first end section 110*a* and second end section 110*b* have portions that overlap, or portions that are both adjacent and parallel. Stated another way, the sum the first end section 110*a* and second end section 110*b* is greater than the fourth side 124, because of the parallel or overlapping portions. In this case, the bridge section 111 is a dielectric gap capacitor formed between the parallel portions of the first end section 110*a* and the second end section 110*b*.

Referring to either FIG. 1C or FIG. 2, the quasi loop 110 has second side 120 and a third side 122 orthogonal to the first side 114 and a capacitively-loaded fourth side 124 parallel to the first side 114. The capacitively-loaded fourth side 124 includes the first end section 110*a* with a distal end 128 connected to the second side 120, and a proximal end 130. The second end section 110*b* has a distal end 134 connected to the third side 122, and a proximal end 135. The bridge section (dielectric gap capacitor) 111 is formed between the first and second sections 110*a* and 110*b*, respectively. For example, the dielectric may be air. As noted above, the combination of the first side 114, second side 120, third side 122, and the capacitively-loaded side 124 define the quasi loop perimeter.

The second side 120 has a first length 140 and the third side 122 has second length 142, not equal to the first length 140. The first side 114 has a third length 144, the first end section 110*a* has a fourth length 146 and the second end section 110*b* has a fifth length 148. In this variation, the sum of the fourth length 146 and fifth length 148 is greater than the third length 144. In other rectangular shape variations, see FIGS. 5A and 5B, the second and third sides 120/122 are the same length, That is, the second and third sides 120/122 are the same length in a vertical plane, while the first and second end sections 110*a* and 110*b* are angled in a horizontal plane to avoid contact, forming a dielectric gap capacitor. An overlap, or parallel section 126 between the first end section 110*a* and the second and section 110*b* helps define the dielectric gap capacitance, as the capacitance is a function of a distance 132 between sections 110*a*/110*b* and the degree of overlap 126.

Figure 4A:
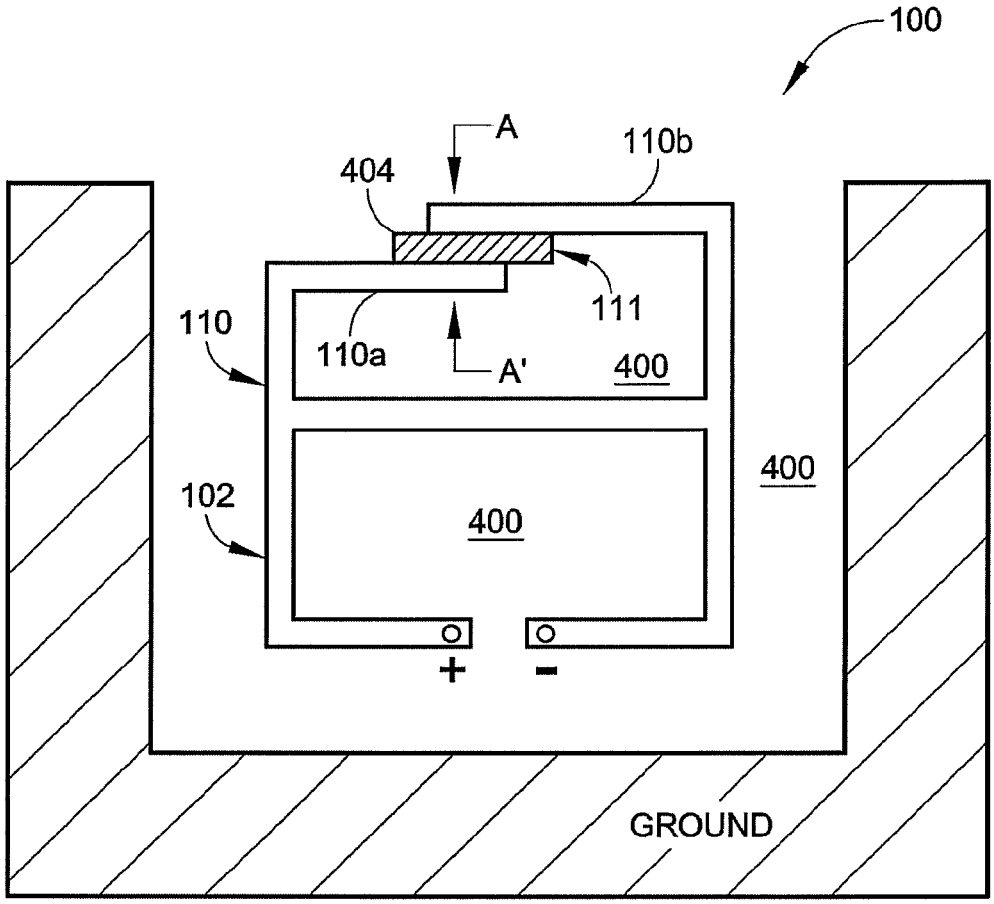
FIGS. 4A and 4B are plan and partial cross-sectional views, respectively, of a third variation of the antenna of FIG. 1B.
Figure 4B:
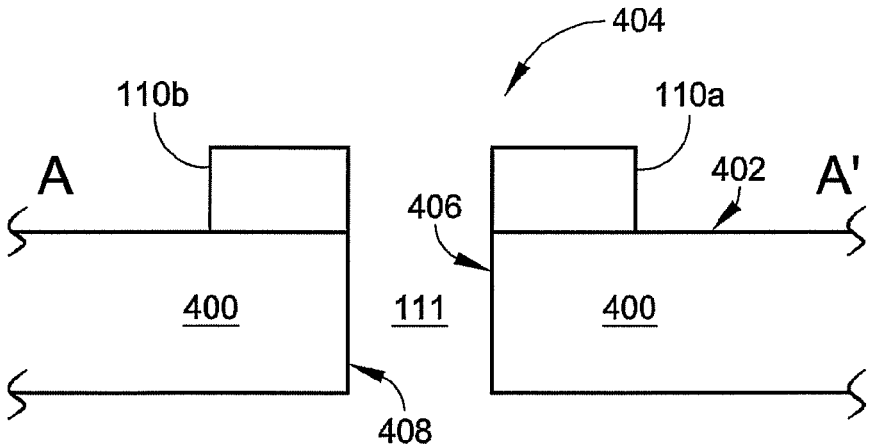

FIGS. 4A and 4B are plan and partial cross-sectional views, respectively, of a third variation of the antenna of FIG. 1B. Shown is a sheet of dielectric material 400 with a surface 402. For example, the dielectric sheet may be FR4 material, or a section of a PCB. The transformer loop 102 and quasi loop 110 are metal conductive traces formed overlying the sheet of dielectric material 400. For example, the traces can be ½ ounce copper. The dielectric material 400 includes a cavity 404. The cavity 404 is formed in the dielectric material surface 402 between a cavity first edge 406 and a cavity second edge 408. The quasi loop first end section 110*a* is aligned along the dielectric material cavity first edge 406, the second end section 110*b* is aligned along the cavity second edge 408. As shown, the bridge section 111 is an air gap capacitor formed in the cavity 404 between the cavity first and second edges 406/408. Alternately, the cavity 404 can be filled with a dielectric other than air.

Figure 5A:
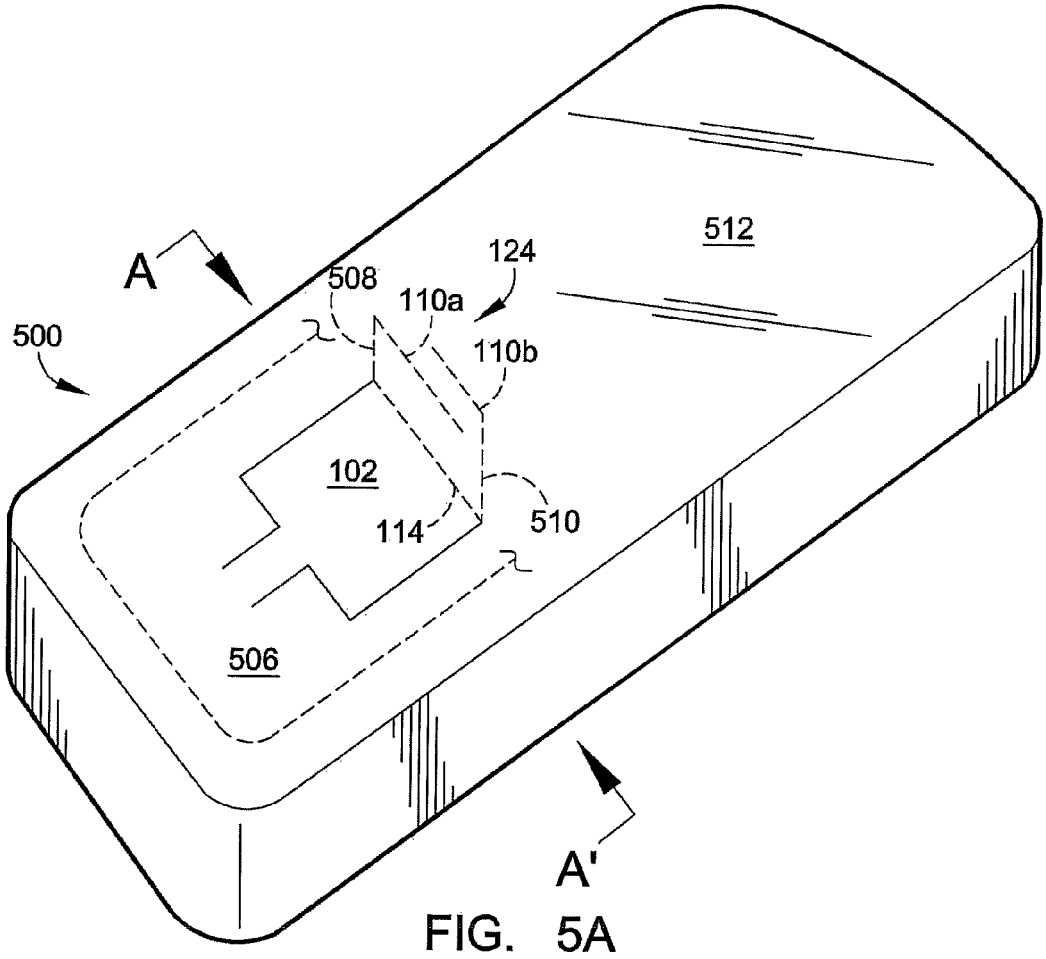
FIGS. 5A and 5B are plan and cross-sectional views, respectively, of a fourth variation of the antenna of FIG. 1B.
Figure 5B:
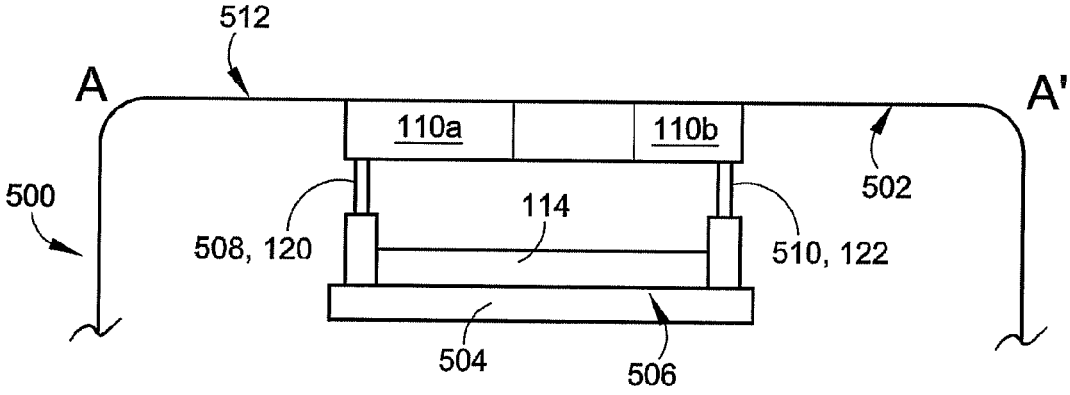

FIGS. 5A and 5B are plan and cross-sectional views, respectively, of a fourth variation of the antenna of FIG. 1B. A chassis 500 has a surface 502. The chassis 500 may be a housing of a wireless modem card 2. Where the wireless modem card 2 is a PCMCIA card, the housing 500 has a form and dimensions that meets the requirements of one of the PCMCIA standards. In this example, the surface 502 is a chassis interior surface. A sheet of dielectric material 504 with a top surface 506, underlies the chassis surface 502. The transformer loop 102 and quasi loop first side 114 are metal conductive traces formed overlying the dielectric material top surface. Alternately but not shown, the traces can be internal to dielectric sheet 504, or on the opposite surface. The quasi loop fourth side 124, with sections 110*a* and 110*b*, is a metal conductive trace formed on the chassis surface 502. Alternately but not shown, the capacitively-loaded fourth side 124 is formed on a chassis outside surface, internal to the chassis, or at different levels in the chassis, i.e., on the inside and outside surfaces.

Pressure-induced electrical contact 508 forms the quasi loop second side 120 and pressure-induced electrical contact 510 forms the quasi loop third side 122, connecting the first side 114 to the fourth side 124. For example, the pressure-induced contacts 508/510 may be pogo pins or spring slips. As shown, the first end section 110*a* and second end section 110*b* are angled in the horizontal plane so that they do not touch, forming a dielectric gap capacitor. Alternately but not shown, the first end section 110*a* can be mounted to the chassis bottom surface 502 and the second end section 110*b* can be mounted to a chassis top surface 512. In this example not shown, the pressure-induced contact interfacing with the chassis top surface trace is longer than the contact interfacing with the chassis bottom surface trace, and sections 110*a*/110*b* do not need to be angled in the horizontal plane to avoid contact.

Figure 5C:
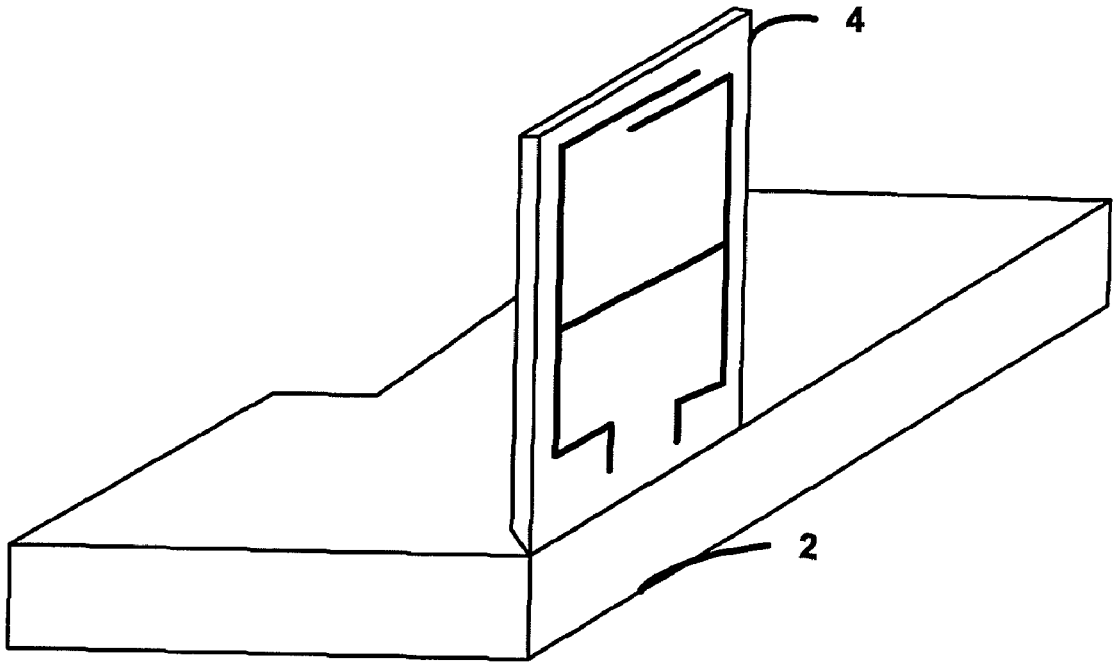
FIG. 5C is a perspective view of a block diagram of a PCMCIA card with an external balanced antenna.

FIG. 5C is a perspective view of a modem card 2 with a balanced antenna 4 that is external to the housing of the modem card 2. In some situations, the balanced antenna 4 is external to the modem card 2. Although the balanced antenna 4 may be mounted in a fixed position, the balanced antenna 4 may be retractable or hinged to allow the external antenna 4 to be retracted or folded closer to the housing of the modem card 2, allowing for a compact form factor when not in use. Any of numerous other techniques may be used to connect the external balanced antenna 4 to the housing to allow rotation, retraction or other types of positioning relative to the housing.

Figure 6:
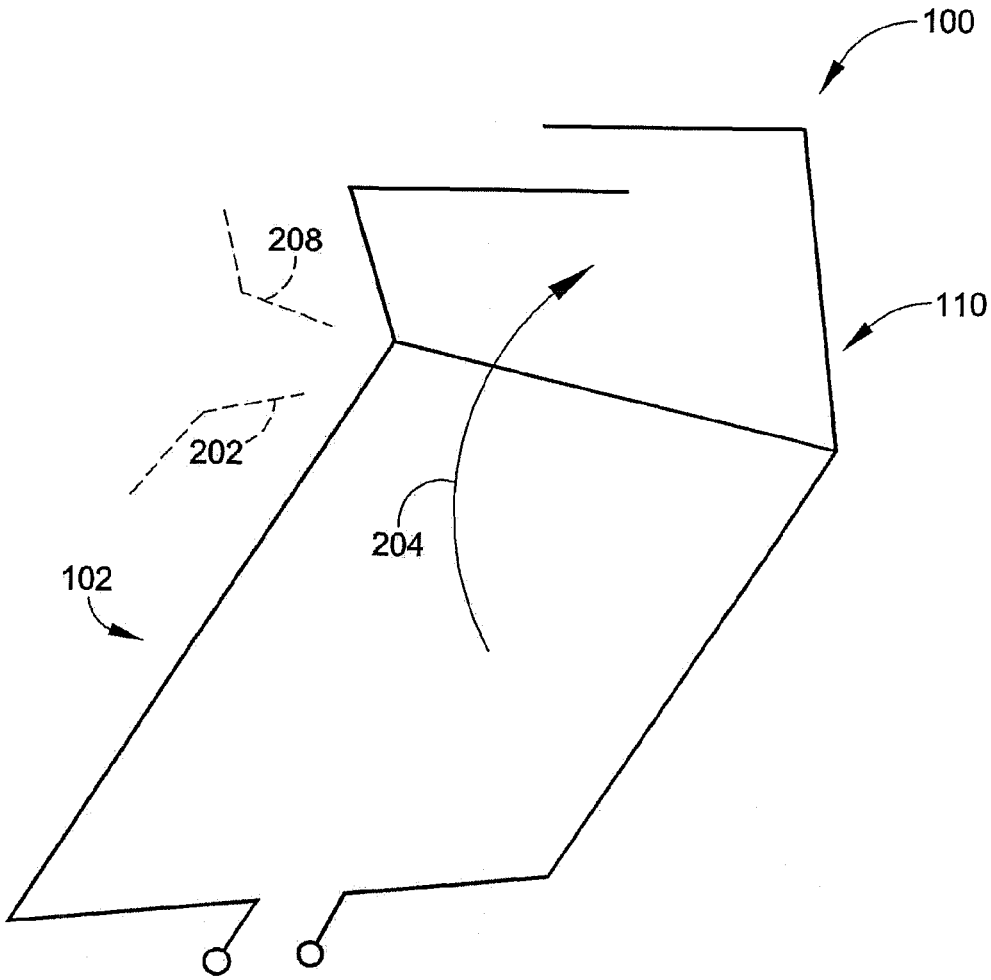
FIG. 6 is a depiction of a fifth variation of the antenna of FIG. 1B.

FIG. 6 is a depiction of a fifth variation of the antenna of FIG. 1B. In this variation, the quasi loop second plane 208 is not perfectly orthogonal to the magnetic near-field 204. Although not shown in this figure, this variation of the exemplary embodiment can be implemented in the physically independent loop antenna of FIG. 2.

Figure 10:
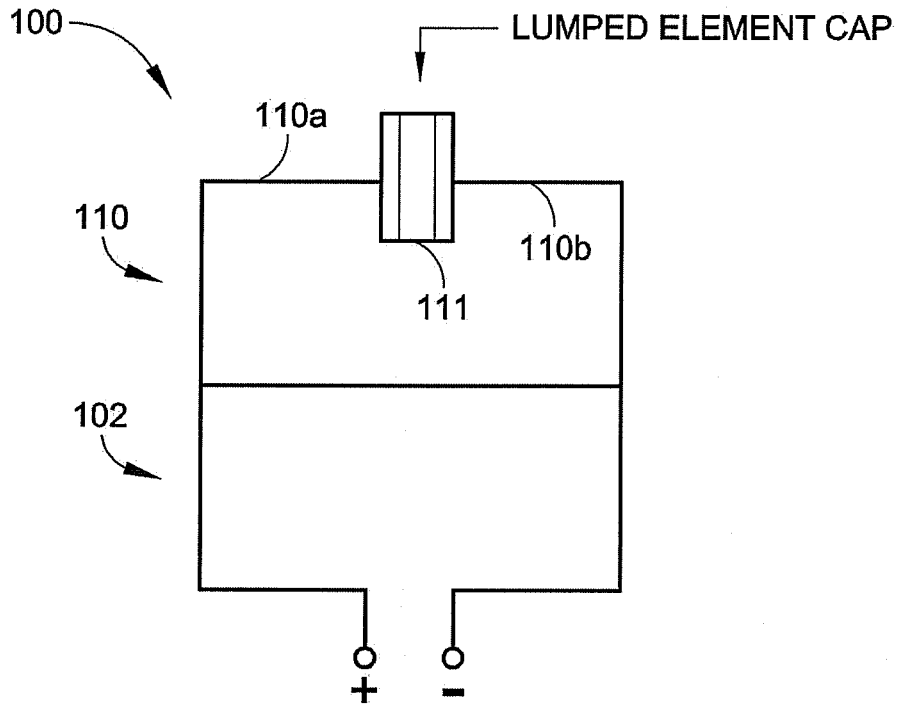
FIG. 10 is a depiction of a sixth variation of the antenna of FIG. 1B.

FIG. 10 is a depiction of a sixth variation of the antenna of FIG. 1B. As shown, the bridge section 111 is a lumped element capacitor.

Figure 11:
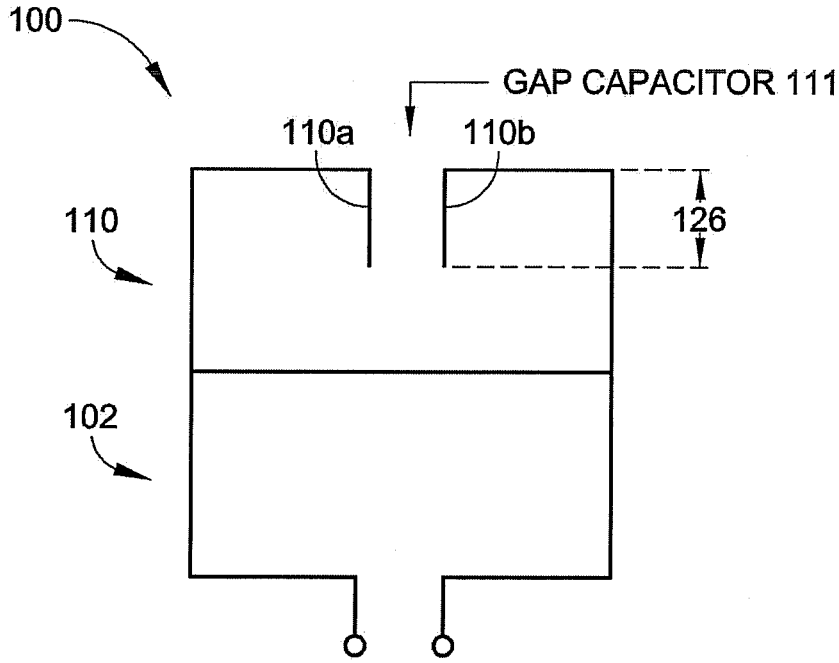
FIG. 11 is a depiction of a seventh variation of the antenna of FIG. 1B.

FIG. 11 is a depiction of a seventh variation of the antenna of FIG. 1B. As shown, the bridge section 111 is a dielectric gap capacitor formed between first and second end sections 110*a*/110*b* that have an overlap 126 that is folded into the center of the quasi loop 110.

Figure 12:
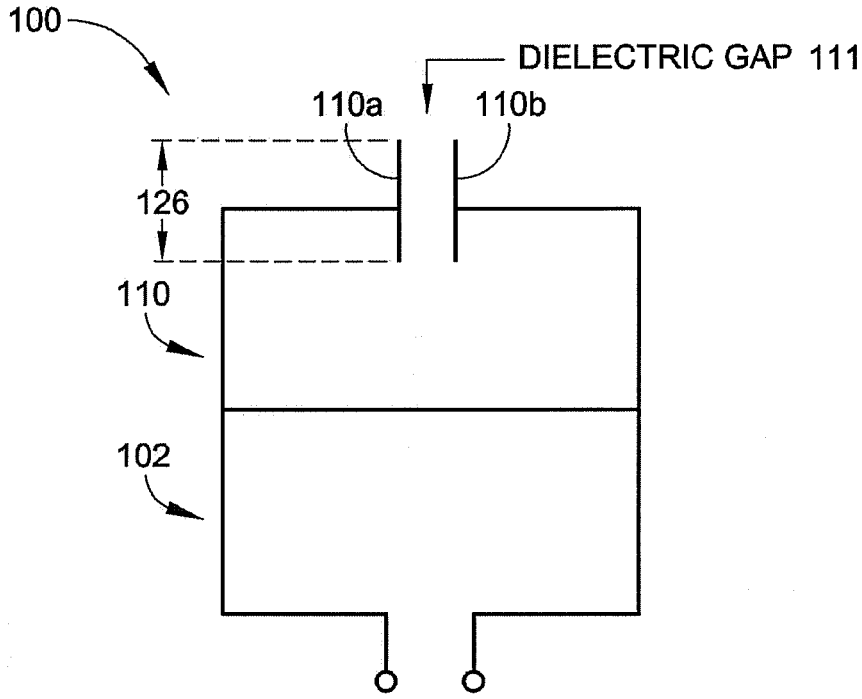
FIG. 12 is a depiction of an eighth variation of the antenna of FIG. 1B.

FIG. 12 is a depiction of an eighth variation of the antenna of FIG. 1B. As shown, the bridge section 111 is a dielectric gap capacitor. The first and second end sections have an overlap 126 that is folded both into the center, and out from the center of the quasi loop 110. Alternately stated, the parallel or overlapping parts of first and second end sections 110*a*/110*b* are perpendicular to the other parts of the first and second end sections that form the quasi loop perimeter.

Figure 13:
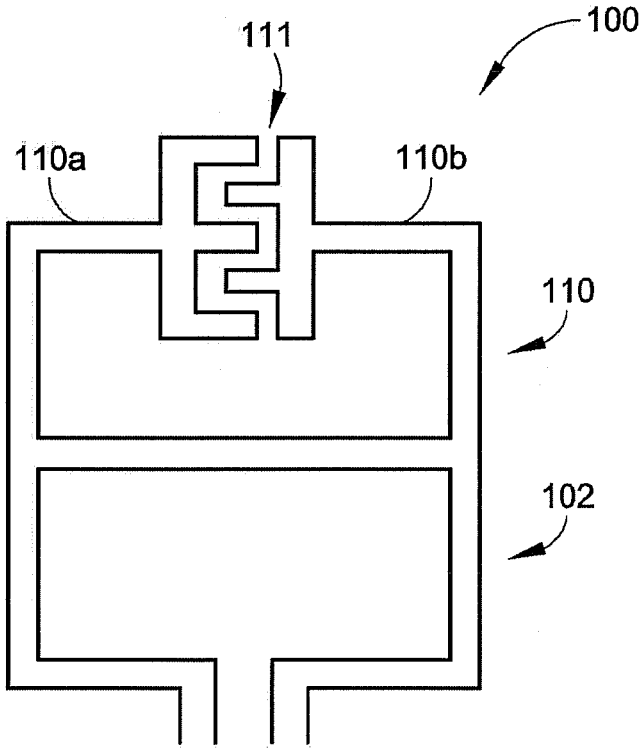
FIG. 13 is a depiction of a ninth variation of the antenna of FIG. 1B.

FIG. 13 is a depiction of a ninth variation of the antenna of FIG. 1B. As shown, the bridge section 111 is an interdigital dielectric gap capacitor. FIGS. 11, 12, and 13 depict just three of the many possible ways in which it is possible to form overlapping or parallel portions of the first and second end sections. The invention is not limited to any particular first and second end section shapes.

Figure 7:
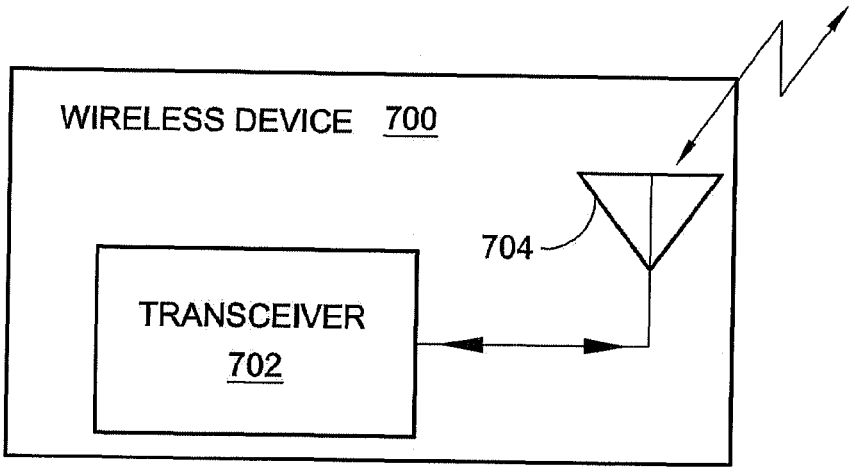
FIG. 7 is a schematic block diagram of the exemplary portable wireless telephone communications device capacitively-loaded loop antenna.

FIG. 7 is a schematic block diagram of the exemplary portable wireless telephone communications device capacitively-loaded loop antenna. The wireless telephone device 700 comprises a telephone transceiver 702. The invention is not limited to any particular communication format, i.e., the format may be CDMA or GSM. Neither is the device 700 limited to any particular range of frequencies. The wireless device 700 also comprises a balanced feed capacitively-loaded loop antenna 704. Details of the antenna 704 are provided in the explanations of FIGS. 1B through 6 and 10 through 13, above, and will not be repeated in the interests of brevity. The variations of the antenna shown in either FIGS. 5A and 5B, or 6 are examples of specific implementations that can be used in a wireless modem device.

Figure 8:
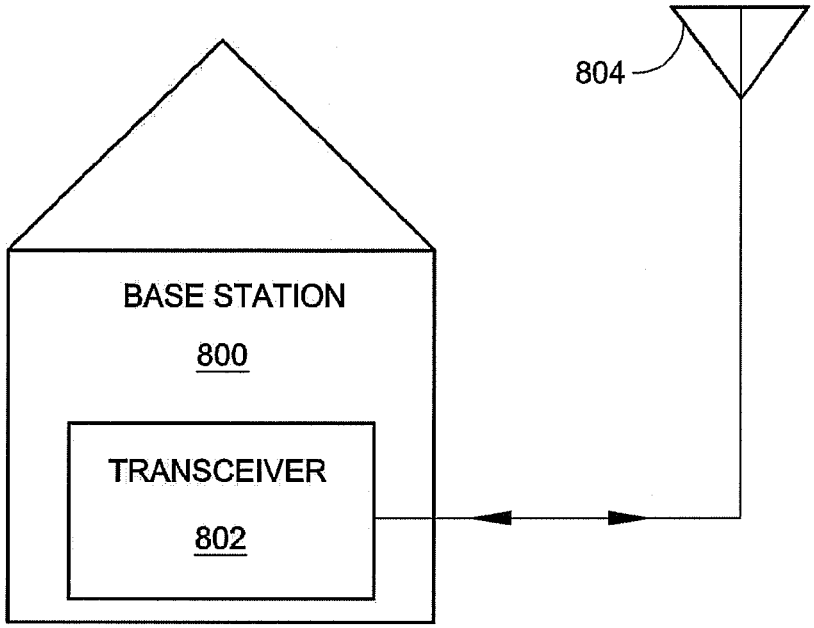
FIG. 8 is a schematic block diagram of the exemplary wireless telephone communications base station with a capacitively-loaded loop antenna.

FIG. 8 is a schematic block diagram of the exemplary wireless telephone communications base station with a capacitively-loaded loop antenna. The base station 800 comprises a base station transceiver 802. Again, the invention is not limited to any particular communication format or frequency band. The base station 800 also comprises a balanced feed capacitively-loaded loop antenna 804, as described above. The base station may use a plurality of capacitively-loaded loop antennas 804. The exemplary antenna advantageously reduces coupling between individual antennas and reduces the overall size of the antenna system.

Functional Description

Figure 9:
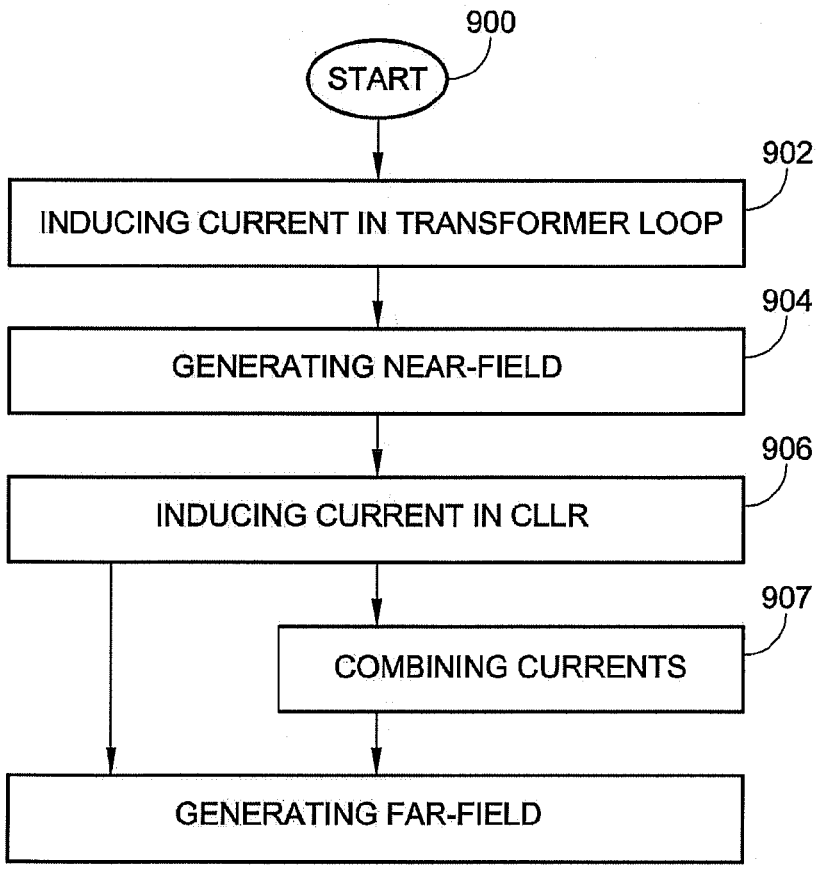
FIG. 9 is a flowchart illustrating the exemplary capacitively-loaded loop radiation method.

FIG. 9 is a flowchart illustrating the exemplary capacitively-loaded loop radiation method. Although the method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 900.

Step 902 induces a first electrical current flow through a transformer loop from a balanced feed. Step 904, in response to the first current flow thorough the transformer loop, generates a magnetic near-field. Step 906, in response to the magnetic near-field, induces a second electrical current flow through a capacitively-loaded loop radiator (CLLR). Step 908 generates an electro-magnetic far-field in response to the current flow through the capacitively-loaded loop radiator. As described above, the CLLR includes a quasi loop and bridge section. Alternately stated, Step 908 generates an electro-magnetic far-field by confining an electric field. Step 908 may generate a balanced electro-magnetic far-field. Generally, these steps define a transmission process. However, it should be understood that the same steps, perhaps ordered differently, also describe a radiated signal receiving process.

In some aspects, such as when the loops are physically connected (see FIG. 1C), an additional step, Step 907, generates a third electrical current flow, which is a combination of the first and second current flows through a loop perimeter section shared by both the transformer loop and the capacitively-loaded loop radiator. For example, the first and second currents may tend to cancel, yielding a net (third) current of zero. Typically, a more perfectly balanced radiator results in lower value of third current flow.

In another aspect, generating a magnetic near-field in response to the first current flow through the transformer loop in Step 904 includes generating the magnetic near-field orthogonal to a transformer loop area formed in a first plane. Then, inducing a second electrical current flow through a capacitively-loaded loop radiator in response to the magnetic near-field (Step 906) includes accepting the magnetic near-field orthogonal to a capacitively-loaded loop radiator area formed in a second plane.

For example, generating the magnetic near-field orthogonal to a transformer loop area formed in a first plane (Step 904), and accepting the magnetic near-field orthogonal to a capacitively-loaded loop radiator area formed in a second plane (Step 906), may include the first and second planes being coplanar (see FIG. 1B). In another aspect, the first and second planes are non-coplanar (while remaining orthogonal to the near-field), see FIG. 3. In other aspects, the CLLR second plane is not orthogonal to the near-field generated in Step 904 (see FIG. 6).

In another aspect the loops are physically independent, see FIG. 2. Then, inducing a first electrical current flow through a transformer loop (Step 902) includes inducing only the first current flow through all portions of the transformer loop. Inducing a second electrical current flow through a capacitively-loaded loop (Step 906) includes inducing only the second current flow through all portions of the capacitively-loaded loop. Alternately stated, the transformer loop and the CLLR do not share any electrical current flow.

In a different aspect, inducing a first electrical current flow through a transformer loop from a balanced feed (Step 902) includes accepting a first impedance from the balanced feed. Then, inducing a second electrical current flow through a capacitively-loaded loop radiator in response to the magnetic near-field (Step 906) includes transforming the first impedance to a second impedance, different from the first impedance. Alternately stated, the transformer loop provides an impedance transformation function between the balanced feed and the CLLR.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

What is claimed is:

1. A modem card comprising:

a connector having pin configuration in accordance with a Personal Computer Memory Card International Association (PCMCIA) standard;

electronics connected to the connector; and a balanced antenna connected to the electronics, the balanced antenna comprising a transformer loop having a balanced feed interface and a capacitively-loaded loop radiator coupled to the transformer loop.

2. The modem card of claim 1, wherein electronics comprise a cellular transceiver.

3. The modem card of claim 2, wherein the balanced antenna is a dipole antenna.

4. The modem card of claim 1, wherein the capacitively-loaded loop radiator is a balanced radiator.

5. The modem card of claim 1, wherein the capacitively-loaded loop radiator comprises:

a quasi loop with a first end section and a second end section; and a bridge section interposed between the quasi loop first and second end sections.

6. The modem card of claim 5, wherein the bridge section is an element selected from the group including a dielectric gap capacitor and a lumped element capacitor.

7. The modem card of claim 5 wherein the quasi loop first end section comprises a portion formed parallel to a second end section portion and wherein the bridge section is a dielectric gap capacitor formed between the parallel portions of the first and second end sections.

8. The modem card of claim 5, wherein the transformer loop has a radiator interface and wherein the quasi loop has a transformer interface coupled to the transformer loop radiator interface.

9. The modem card of claim 8, wherein the transformer loop has a first perimeter; and, wherein the quasi loop has a second perimeter with at least a portion of the second perimeter in common with the first perimeter.

10. The modem card of claim 9, wherein the transformer loop has a rectangular shape with a first side and wherein the quasi loop has a rectangular shape with the first side.

11. A cellular modem card comprising:

a connector having pin configuration in accordance with a Personal Computer Memory Card International Association (PCMCIA) standard;

electronics connected to the connector and comprising a cellular transceiver; and a balanced antenna connected to the cellular transceiver, the balanced antenna comprising a transformer loop having a balanced feed interface and a capacitively-loaded loop radiator coupled to the transformer loop.

12. The cellular modem card of claim 11, wherein the balanced capacitively-loaded loop radiator comprises:

a quasi loop with a first end section and a second end section; and a bridge section interposed between the quasi loop first end section and the second end section.

13. The cellular modem card of claim 12, wherein the transformer loop has a radiator interface and a first perimeter and wherein the quasi loop has a transformer interface coupled to the transformer loop radiator interface, the quasi loop having a second perimeter with at least a portion of the second perimeter in common with the first perimeter.

14. A cellular modem card comprising:

a housing having a form conforming to a Personal Computer Memory Card International Association (PCMCIA) standard;

a connector having pin configuration and a form in accordance with the PCMCIA standard secured to the housing;

electronics connected to the connector and comprising a cellular transceiver; and a balanced antenna connected to the cellular transceiver, the balanced antenna comprising a transformer loop having a balanced feed interface and a capacitively-loaded loop radiator coupled to the transformer loop.

15. The cellular modem card of claim 14, wherein the balanced capacitively-loaded loop radiator comprises:

a quasi loop with a first end section and a second end section; and a bridge section interposed between the quasi loop first end section and the second end section.

16. The cellular modem card of claim 15, wherein the bridge section is an element selected from the group including a dielectric gap capacitor and a lumped element capacitor.

17. The cellular modem card of claim 15 wherein the quasi loop first end section comprises a portion formed parallel to a second end section portion and wherein the bridge section is a dielectric gap capacitor formed between the parallel portions of the first and second end sections.

18. The cellular modem card of claim 15, wherein the transformer loop has a radiator interface and wherein the quasi loop has a transformer interface coupled to the transformer loop radiator interface.

19. The cellular modem card of claim 18, wherein the transformer loop has a first perimeter; and, wherein the quasi loop has a second perimeter with at least a portion of the second perimeter in common with the first perimeter.

20. The cellular modem card of claim 19, wherein the transformer loop has a rectangular shape with a first side and wherein the quasi loop has a rectangular shape with the first side.

* * * * *